US005784886A

United States Patent [19]

Prueitt

[11] Patent Number: 5,784,886

[45] Date of Patent: Jul. 28, 1998

[54] HYDRO-AIR RENEWABLE POWER SYSTEM

[76] Inventor: Melvin L. Prueitt, 161 Cascabel, Los Alamos, N. Mex. 87544

[21] Appl. No.: 656,885

[22] Filed: May 30, 1996

Related U.S. Application Data

[62] Division of Ser. No. 518,499, Aug. 23, 1995, Pat. No. 5,551,238.

[51] Int. Cl.[6] ..... F01K 25/06

[52] U.S. Cl. ..... 60/649; 60/673; 261/112.1

[58] Field of Search ..... 60/643, 649, 673, 60/641.2, 641.5, 641.9; 62/484, 485; 261/111, 112.1

[56] References Cited

U.S. PATENT DOCUMENTS 3,997,635 12/1976 Hallgren ..... 261/112.1
4,617,800 10/1986 Assaf ..... 60/649

FOREIGN PATENT DOCUMENTS 378621 7/1923 Germany ..... 261/112.1

*Primary Examiner*—Noah P. Kamen

[57] ABSTRACT

A power generating system is powered by a circulating working fluid that is heated by heat of condensation deposited in a concentrated brine solution. A condenser transfers heat from working fluid vapor exhaust from the turbine to cooling water to form a condensed working fluid and heat the cooling water to a first vapor pressure. A heat transfer chamber has a concentrated brine solution in vapor communication with the cooling water so that vapor from the cooling water at the first vapor pressure will condense on the brine solution for diluting and heating the brine solution. For efficient heat and vapor transfer, the cooling water and the brine solution are caused to flow along opposed surfaces. A boiler is placed in heat transfer communication with the brine solution for receiving heat from the brine solution and heating the condensed working fluid to a vapor for input to the turbine.

2 Claims, 4 Drawing Sheets

HYDRO-AIR RENEWABLE POWER SYSTEM

This is a divisional of application Ser. No. 08/518,499 filed on Aug. 23, 1995 now U.S. Pat. No. 5,551,238.

BACKGROUND OF THE INVENTION

This invention relates to renewable power systems and, more particularly, to renewable power systems using concentrated brine as the energy storage medium.

All heat engines utilize a temperature differential to produce power. Reciprocating engines produce a hot gas and, after the power stroke, dump the remaining energy to a lower temperature environment. The Rankine cycle relies on two heat reservoirs at different temperatures. The idea of using the warm ocean surface and the cold deep ocean as two heat reservoirs was proposed as early as 1901 by d'Aronval.

The concept of the present invention is based on a large scale absorption cycle using a concentrated salt solution or other hygroscopic solution, herein referred to as "brine," as an energy storage medium. As used herein, brine means a water solution of salts (acid, alkaline or neutral). Basically, energy is stored in brine by evaporating solvent, e.g., water, from the solution, whereby the salt is concentrated and the brine has a vapor pressure that is low compared to pure solvent. If a source of the pure solvent and a source of concentrated brine are placed so that the volumes above the solvent and brine are in communication at about the same initial temperatures, vapor from the solvent will condense on the brine due to the low vapor pressure adjacent the brine. The evaporation of solvent extracts a latent heat of vaporization from the solvent, lowering the solvent temperature. The condensation of solvent vapor on the brine deposits the latent heat of vaporization in the brine, raising the brine temperature. This process continues until a temperature difference arises that equalizes the vapor pressure above the solvent and above the brine. See, e.g., N. Isshiki, "The Concentration Difference Energy System," 2 J. Non-Equilb. Thermodyn., No. 2, pp. 85–107 (1977), incorporated herein by reference.

Useful energy can now be extracted from the brine. Isshiki, supra, and Assaf in U.S. Pat. No. 4,617,800 propose series and parallel boiler arrangements, respectively, to extract energy from the brine. In both cases the brine is used only once. Assaf proposes a heat exchanger with a heat conductive barrier that separates the heat exchanger into two compartments, one of which constitutes the condenser side, and the other of which constitutes the evaporator side. Concentrated brine from the brine source is caused to fall in a film on the condenser side of the barrier for effecting condensation of the heat depleted vaporized working fluid, such condensation releasing the latent heat of condensation to the brine, which is warmed as it is diluted. Liquid working fluid from a source is caused to fall in a film on the evaporator side of the barrier. Heat from the warmed brine film is transferred through the barrier to the cooler film of liquid working fluid, which, in the reduced pressure of the evaporator side, flashes into vapor that is conducted to a turbine. Since Assaf interfaces the brine with the heat depleted vaporized working fluid, the system is usable only with water as the working fluid.

Isshiki teaches a series of chambers operated at progressively higher pressure and temperature to form a steam for running a turbine. Exhaust from the turbine is used to heat the brine in one of the stages. Again, brine is injected into the stages in parallel so that a brine solution is used only once.

A source of concentrated brine is required with stored energy in the form of the concentrated salt. U.S. Pat. No. 4,704,189 to Assaf contemplates the use of large spray towers for converting solar energy to "concentration energy" as a dilute brine is sprayed in the direction of a prevailing air flow with a concomitant loss of the evaporated water from the brine solution. Isshiki contemplates the use of waste heat from various sources to provide the energy that is converted to concentration energy.

Accordingly, it is an object of the present invention to provide for extracting energy from the brine at one or more dilution stages.

It is another object of the present invention to provide a non-aqueous working fluid for driving a turbine, expander, or the like.

One other object of the present invention is to optimize the use of hot dry air to concentrate the brine wherein the solar energy in the air is converted to concentration energy in the brine.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

To achieve the foregoing and other objects, and in accordance with the purposes of the present invention, as embodied and broadly described herein, the apparatus of this invention may comprise a power generating system powered by a circulating working fluid that is heated by heat of condensation deposited in a concentrated brine solution. A condenser transfers heat from working fluid vapor exhaust from the turbine to cooling water to form a condensed working fluid and heat the cooling water to a first vapor pressure. A heat transfer chamber has a concentrated brine solution in vapor communication with the cooling water so that vapor from the cooling water at the first vapor pressure will condense on the brine solution for diluting and heating the brine solution. A boiler is placed in heat transfer communication with the brine solution for receiving heat from the brine solution and heating the condensed working fluid to a vapor for input to the turbine.

In a particular embodiment of the invention, the condenser has a first heat transfer partition for condensing exhaust vapor of the working fluid from the turbine on a first surface wherein a first latent heat of condensation heats the first heat transfer partition to form condensed working fluid from the vapor. A heat transfer chamber is formed by a second surface of the first heat transfer partition and a first surface of a second heat transfer partition, wherein the first surface of the second heat transfer partition is separated from and in volume communication with the second surface of the first heat transfer partition. A water inlet provides a flowing water along the second surface of the first heat transfer partition, wherein the flowing water is heated to have a first vapor pressure by transfer of the first latent heat of condensation through the first heat transfer partition. A concentrated brine inlet flows concentrated brine along the first surface of the second heat transfer partition, wherein the concentrated brine has a second vapor pressure less than the first vapor pressure of the flowing water so that vapor from the flowing water condenses on the flowing concentrated brine to release a second latent heat of condensation to heat the concentrated brine solution. A boiler contacts the condensed working fluid with a second surface of the second heat transfer partition so that the working fluid is heated to a vapor state for turning the turbine as the concentrated brine solution is heated and diluted from condensation of the vapor from the flowing water.

A brine concentrator is provided as a component part of the power generating system. In accordance with one embodiment, the brine concentrator includes an air flow heat exchanger for admitting hot dry air at one end and for exhausting cool humid air at another end. A warm water loop contacts the air flow heat exchanger for extracting heat from the air flow to heat a circulating water flow. A cool water loop contacts the air flow heat exchanger for adding energy to the air. A water spray in the air flow heat exchanger intermediate the warm water loop and the cool water loop acts as an energy exchange medium between the cool water loop and the hot dry air. A brine concentrating unit receives relatively dilute brine, wherein the relatively dilute brine is heated by the warm water loop to evaporate water from the brine solution to form a more concentrated brine solution and the evaporated water is condensed by the cool water loop.

In another embodiment of a brine concentrator, a plurality of brine outlets inputs a relatively dilute brine solution. A plurality of flow plates receives the brine solution for flowing the relatively dilute brine solution along a plurality of parallel chambers. An ambient dry air flow contacts the relatively dilute brine solution for evaporating water from the solution to form a relatively concentrated brine solution.

In yet another embodiment of a brine concentrator, a plurality of spray heads dispenses a relatively dilute brine solution as a brine spray in a first direction. An ambient air flow is input in a second direct opposite the first direction at a velocity effective to slow the fall rate of the droplets and increase the time of contact between the droplets and the air whereby water is evaporated from the droplets for increased concentration of the brine in the droplets. A plurality of troughs faces the spray heads for collecting the concentrated brine droplets.

BRIEF DESCRIPTION OF THE DRAWINGS

The accompanying drawings, which are incorporated in and form a part of the specification, illustrate the embodiments of the present invention and, together with the description, serve to explain the principles of the invention. In the drawings.

DETAILED DESCRIPTION OF THE INVENTION

Figure 1:
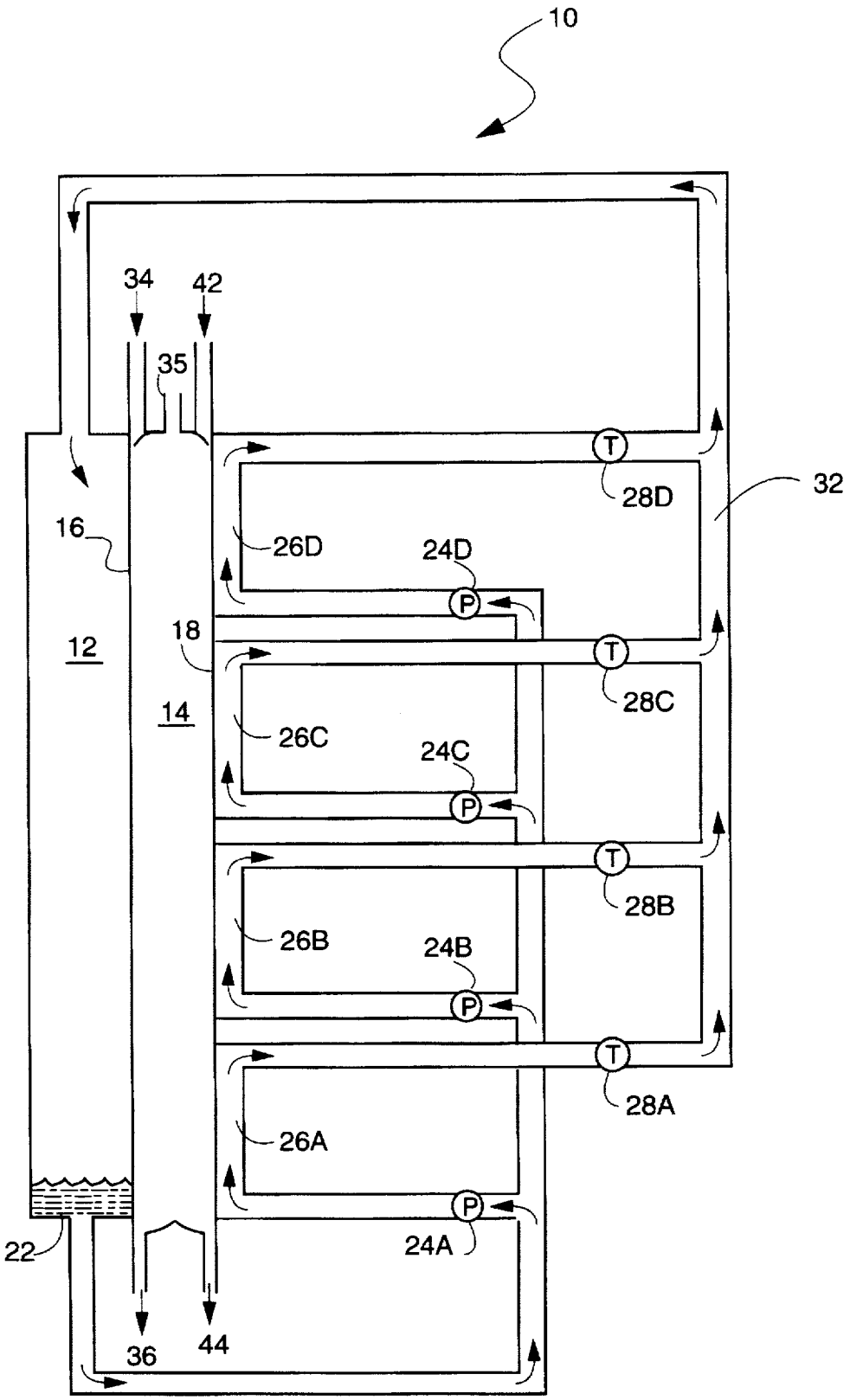
FIG. 1 is a schematic diagram of a power generating system according to one embodiment of the present invention.

Referring first to FIG. 1, there is depicted a schematic diagram of a power generating system 10 according to one embodiment of the present invention. Condenser 12 functions to transfer heat from an exhaust working fluid vapor to water in heat transfer chamber 14. In one embodiment, heat transfer chamber 14 is evacuated, e.g., by vacuum pump, air ejector, or the like 35, to enhance vapor flow within the chamber. As water is heated in chamber 14, the vapor pressure of the water is increased and vapor is formed. The vapor condenses on a concentrated brine solution within chamber 14 with a concomitant heating of the brine. The heat in the brine is transferred to one or more boilers 26A–D to heat a working fluid to drive a power generator such as one or more turbines 28A–D, where the number of turbines is determined by the dilution change in the concentrated brine.

Accordingly, a working fluid delivers energy to turbines 28A–D and the energy-depleted working fluid is delivered to exhaust return 32. As used herein, a working fluid may be water/steam, but is preferably a refrigerant, such as ammonia or propane. Refrigerants produce high pressure vapor at relatively low temperature so that a smaller turbine is required.

The vapor in exhaust return 32 is delivered to condenser 12. Condenser 12 includes heat exchange partition 16 with a first surface for condensing the vapor. A second surface of heat exchange partition 16 also defines one surface of heat transfer chamber 14 and is cooled by flowing water from water inlet 34. The water may be derived from concentrating brine solution, as discussed below, for may be from an independent water source. As water flows along the second surface of partition 16, vapor adjacent the first surface is condensed, releasing its latent heat of vaporization, which is transferred to partition 16 and to water on the second surface to heat the water.

Heat transfer chamber 14 is further defined by second heat transfer partition 18. A concentrated brine solution is provided along a first surface of second heat transfer partition 18 through brine inlet 42. The vapor pressure of the water on the second surface of partition 16 is higher than that of the condensed brine solution on the first surface of second heat transfer partition 18. Accordingly, vapor from the water will flow to and condense on the brine surface. As the vapor condenses, the latent heat of vaporization and the heat of solution are released to heat the brine. The temperature of the brine will increase until an equilibrium vapor pressure is reached. The temperature difference between the water and the brine may be 20° C. or higher depending on the brine concentration.

Thus, in heat transfer chamber 14 water flows down one surface and exits at outlet 36. Concentrated brine flows down an opposing surface. As the water looses heat by evaporation, heat is continuously supplied through partition 16 from the condenser, where the refrigerant vapor is condensing. This transfer method efficiently transfers large quantities of heat. Hot brine on partition 18 delivers its heat to a refrigerant boiler through partition 18 until the hot, dilute brine exits through outlet 44.

One of the energy losses in most low-temperature power systems is that the heat source loses some quality as heat is transferred. In the case of brine, the brine becomes diluted as it absorbs water vapor and is able to support progressively lower temperatures. The refrigerant and boiler effectively operate at the lowest temperature of the heat energy that is provided.

In the prior art approach to minimize reduced heat quality, the brine is diluted only slightly, but this does not efficiently use the brine and large brine storage is required. In accordance with the present invention, the brine is more efficiently used by diluting the brine to a greater degree than prior art embodiments. A first embodiment is shown in FIG. 1, where a plurality of parallel boiler loops are provided. Four loops are shown herein for illustration only.

Brine with the largest concentration enters through inlet 42 and is heated as described above. This heat is transferred to refrigerant in boiler 26D at the highest temperature, which vaporizes and drives turbine 28D. The brine is slightly diluted and then flows to the surface adjacent to boiler 26C. Boiler 26C is then heated, but to a lower temperature, to driver turbine 28C. Each succeeding boiler, boilers 26B and 26A operates at progressively lower temperature as the brine is progressively diluted. All of the four boiler stages exhaust to return line 32 for condensation in condenser 12. Condensate 22 is returned to the respective boiler stages by pumps 24A–D.

Simulations show that a two stage system produces 25% more energy than a single stage system for the same amount of brine. A three stage plant produces 35% more energy than a single stage and a four stage system produces 40% more. It will also be appreciated that the physical geometry of condenser 12 and heat transfer chamber 14 can be adapted to a variety of forms. A simple plate geometry might be used, or a nested tube geometry, or other suitable ways of serially extracting heat from brine.

Figure 2:
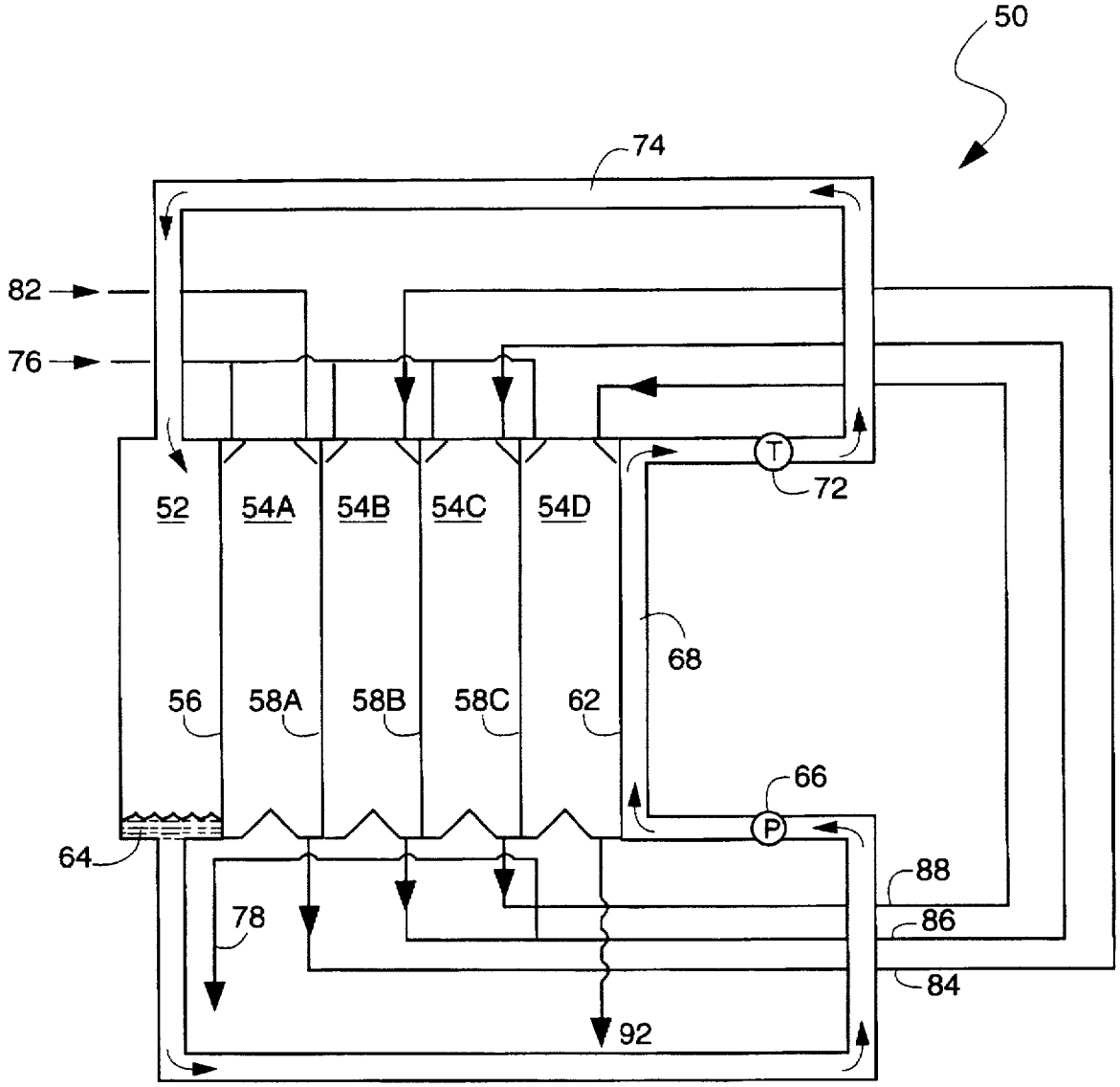
FIG. 2 is a schematic diagram of a power generating system according to a second embodiment of the present invention.

FIG. 2 shows in schematic form a power generating system 50 for using only a single turbine and generator 72. In this embodiment, a plurality of heat transfer chamber 58A–D is used. Exhaust vapor return 74 is provided to condenser 52 with first heat transfer partition 56. As described above, the latent heat of condensation is transferred as vapor condenses on a first surface of partition 56 and heats water introduced through water inlet 76 to a second surface of partition 56 that forms one surface of heat transfer chamber 54A. Brine is input to heat transfer chamber 54A through concentrated brine solution inlet 82 to flow along a first surface of second heat transfer partition 58A. The concentrated brine solution is heated as described for FIG. 1.

In the embodiment shown in FIG. 2, a plurality of heat transfer chambers 58A–D is provided for heating the brine in stages. Heated brine from chamber 58A exits through loop 84 for input to heat transfer chamber 54B. Likewise, heated brine from chamber 58B exits through loop 86 for input to heat transfer chamber 54C; heated brine from chamber 58C exits through loop 88 for input to heat transfer chamber 54D. Water is input through water inlet 76 and is flowed along a corresponding second surface of a heat transfer partition 54B–D. The water is provided to the heat transfer partitions in parallel and is used in each heat transfer chamber and is discharged through outlet 78.

Thus, brine is heated in heat transfer chamber 54A and is transferred to flow along a first surface of heat transfer partition 58B in heat transfer chamber 54B. Water is heated along the second surface of heat transfer partition 58A and the vapor condenses on the brine to heat the brine for heat transfer across heat transfer partition 58B. The process continues serially across heat transfer partitions 58B and 58C. This process produces a high temperature brine on a first surface of heat transfer partition 62 for heat transfer to a refrigerant in boiler 68. The heated, dilute brine exits through outlet 92. For example, if the brine in chamber 58A is heated to a temperature difference of 20° C. above the water film temperature on heat transfer partition 56 the brine in chamber 54B is heated to a temperature difference of 15° C., the brine in chamber 54C is heated to a temperature difference of 10° C., and 5° C. in chamber 54D, then the total temperature difference between condenser 52 and boiler 68 is then 50° C.

Condensate 64 is circulated by pump 66 along a second surface of heat transfer partition 62 to provide a relatively high pressure vapor to drive turbine 72. Turbine 72 operates at a relatively high temperature and concomitant pressure for a high power output.

It will be appreciated by those of ordinary skill in the art that the energy generating systems shown in FIGS. 1 and 2 require a variety of auxiliary pumps and valves to circulate the water and brine flows. In addition, various heat exchangers may be provided to transfer the heat in exhaust water and dilute brine to inlet water and concentrated brine before the water and brine are returned to the heat exchanger units. The design of these auxiliary systems are not within the scope of the present invention and are not discussed in detail herein.

The systems shown in FIGS. 1 and 2 require a source of concentrated brine, where the brine stores ambient energy as concentration energy. It is contemplated that such plants will be built where the humidity is low and there is an availability of water, e.g., sea water. Humidity is generally lower during the day so that the brine concentrator can run during the day to supply concentrated brine to the power plant and to produce extra brine for night operations. For example, a tank 20 meters high and 50 meters in radius could supply a 100 MW power plant for 24 hours.

With sulfuric acid as the brine and propane as the refrigerant, and with an ambient air temperature of 40° C. and a relative humidity of 15%, simulations show that a power plant described above could operate at an efficiency of about 3.6%. That is, for every gram of water used by the plant, 87.4 joules of energy are produced.

Figure 3:
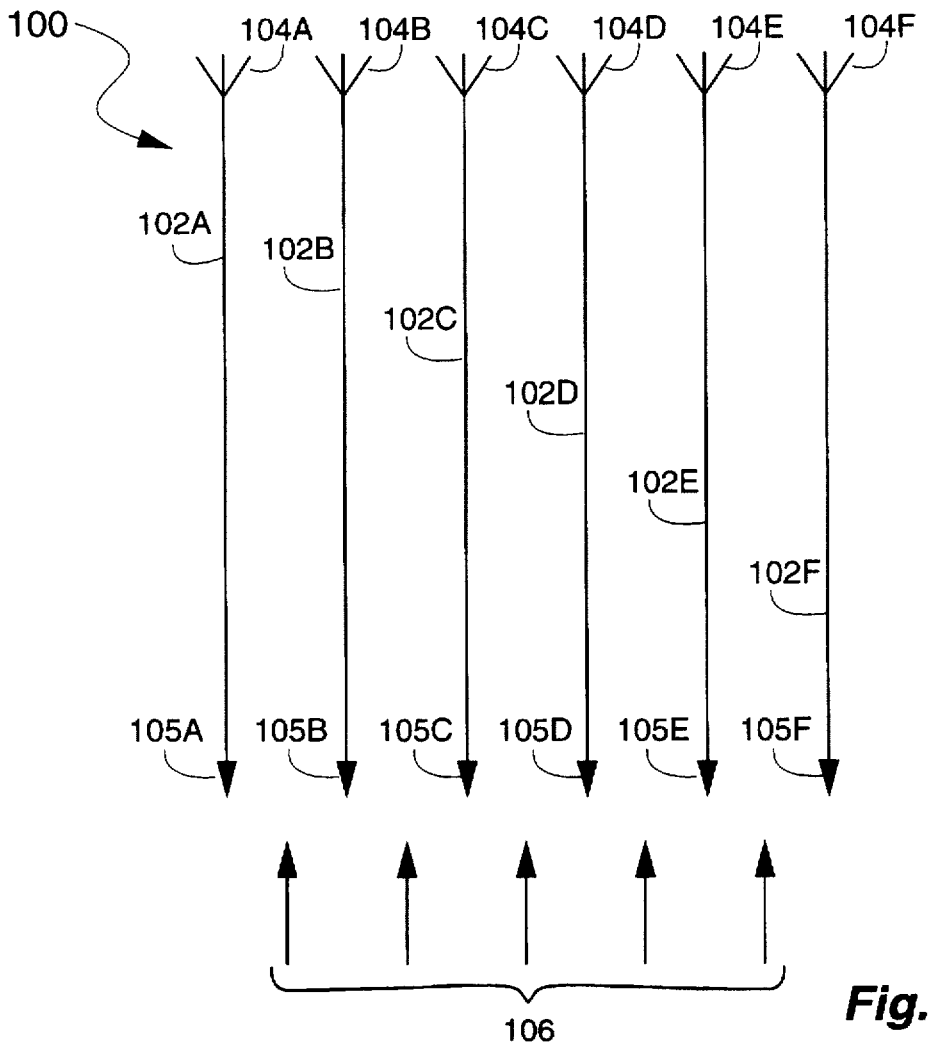
FIG. 3 is a schematic diagram of a brine concentrator as a component of the power generating system.
Figure 4:
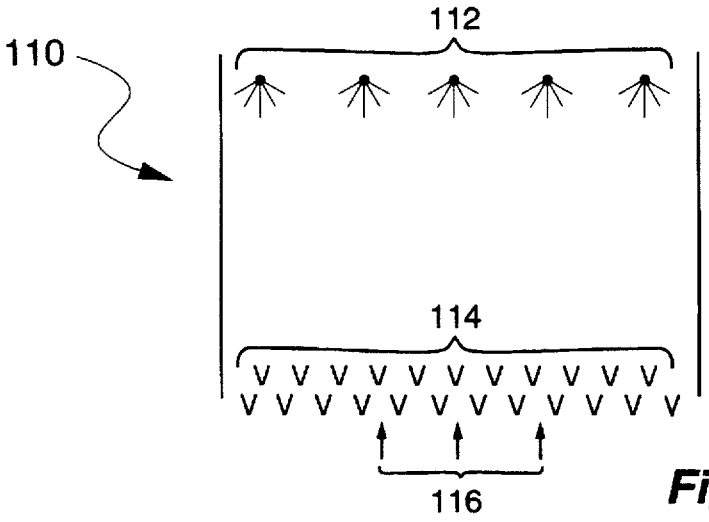
FIG. 4 is a schematic diagram of a spray brine concentrator as a component of the power generating system.
Figure 5:
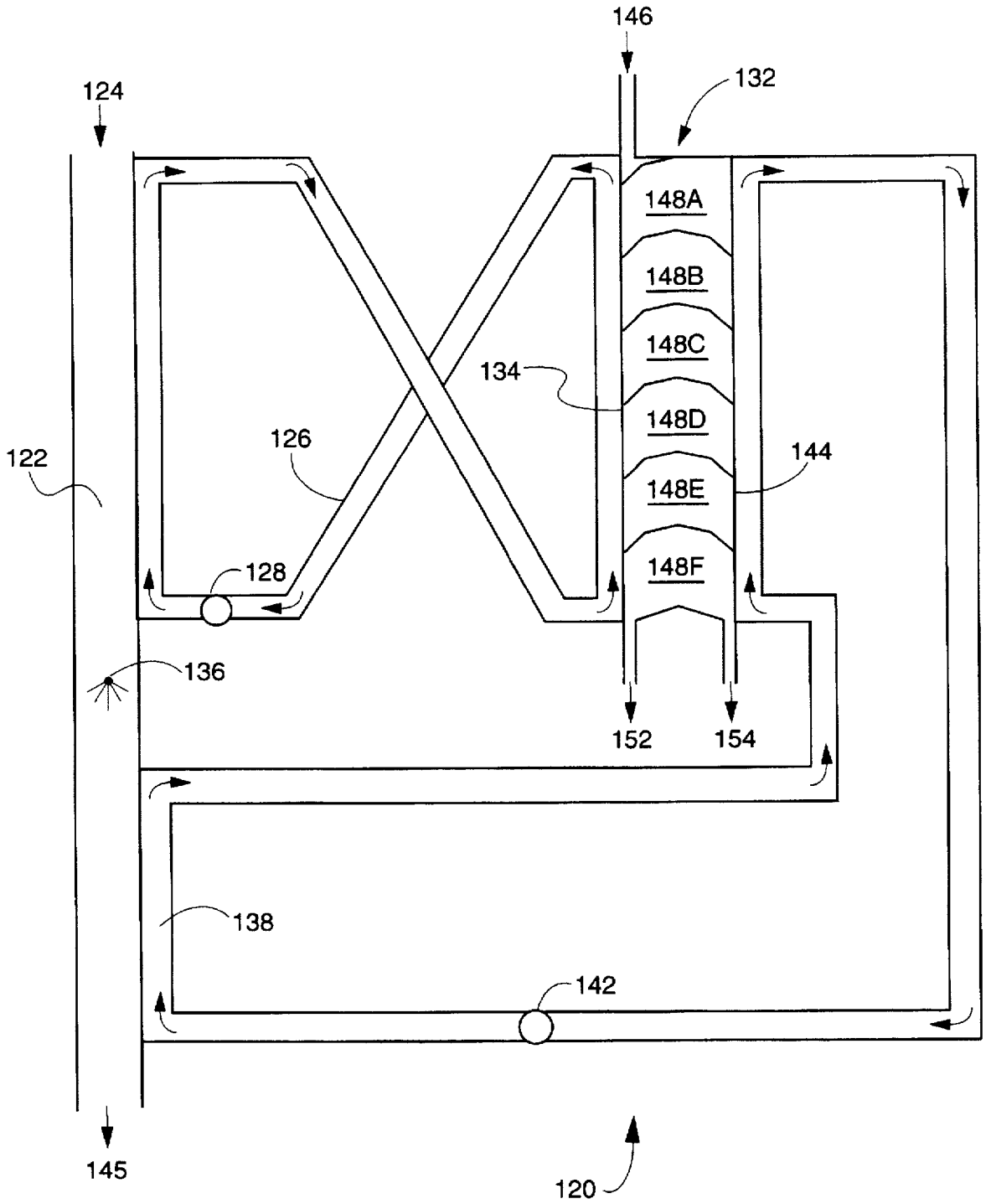
FIG. 5 is a schematic diagram of a brine concentrator using warm/cool air flows.

Suitable brine concentrators are shown in FIGS. 3, 4, and 5. In FIGS. 3 and 4, the brine flow is provided counter to a hot, dry air flow. FIG. 3 depicts a concentrator 100 having a plurality of brine flow walls 102A–F, where brine is introduced through dispensers 104A–F, respectively. Air flow 106 is introduced to flow in a direction opposite to brine so that when the air is the hottest and driest, the brine is the most concentrated with the lowest vapor pressure but can still evaporate water to the hot, dry air. Brine is collected in troughs 105A–F. Channel walls 102A–F are preferably designed to slow the movement of the brine to increase the time of contact between the brine and the air. Exemplary walls are slotted walls of thin metal or plastic or of a fabric or screen with surface features that reduce the brine flow rate. Rather than a counter-flow of air and brine, a cross-flow of air could be used with the air flowing in the channels defined by brine flow walls 102A–F perpendicular to the flow of brine along the surfaces, as discussed above.

Another embodiment is shown in FIG. 4, where concentrator 110 provides brine sprayers 112 to dispense the brine as a spray. With relatively uniform droplet sizes, air flow 116 can be adjusted so that the droplets are affected by the air flow and fall at a slow rate to maximize exposure to the hot dry air. Water in the droplets is evaporated by the dry air so the brine in the droplets becomes more concentrated. Overlapping rows of catch troughs 114 collect the concentrated brine. In one embodiment, the walls of each catch trough 114 are V-shaped, with the V having a small internal angle, i.e., a steep external angle, to reduce the production of secondary droplets.

One of the problems with the brine concentrators shown in FIGS. 3 and 4 is that the brine must be deaerated before entering a heat transfer chamber of the power unit shown in FIGS. 1 and 2, particularly where the heat transfer chamber is evacuated. This difficulty is avoided by brine concentrator system 120 shown in FIG. 5. Water in loop 126 is first heated by hot air 124 in a first section of heat exchanger 122. Water in loop 126 flows counter to hot air 124 for maximum water heating. Pump 128 circulates the heated water to brine concentrator unit 132. A dilute brine is introduced through inlet 146 to flow along a first surface 134 of concentrator unit 132 that is heated by water in heater loop 126. As the brine is heated, water evaporates from the brine and condenses on a second surface 144 of concentrator unit 132.

The second surface of concentrator unit 132 is cooled by water circulating in loop 138 by pump 142. Heat exchanger 122 also provides for cooling hot dry air 124 after the air traverses the first section of heat exchanger 122. Water sprayer 136 provides a water mist within a second section of heat exchanger 122. The water mist contacts a surface that is heated by the cooling water in loop 138, whereby the water mist evaporates and cools the cooling water for return to concentrator unit 132. The air is exhausted through outlet 145.

Brine concentrator unit 132 is divided into a plurality, illustrated by chambers 148A–F in one exemplary embodiment. Both the heated water flow in loop 126 and the cooling water flow in loop 138 are opposite the brine flow in concentrator unit 132. Chambers 148A–F are provided with baffles so that different vapor pressures may be maintained in each chamber. Vapor pressure is highest in chamber 148A and lowest in chamber 148F. Concentrated brine drains along the heated surface 134 of concentration unit 132 and water condensate collects and drains along the cooled surface 144. Concentrated brine is returned through outlet 152 to a storage tank or to a power generating system where the brine is again diluted as power is extracted. Pure water is outlet through outlet 154 and may be used as makeup process water for the power generating system. Since a closed system is provided for the concentrated brine and output water, no dearation is needed for use of the fluids in the power generation systems shown in FIGS. 1 and 2.

The foregoing description of the preferred embodiments of the invention have been presented for purposes of illustration and description. It is not intended to be exhaustive or to limit the invention to the precise form disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. In a power generating system using concentration energy in a concentrated brine solution as an energy source, a brine concentrator comprising:

an air flow heat exchanger for admitting hot dry air at one end and for exhausting cool humid air at another end;

a warm water loop contacting said air flow heat exchanger for extracting heat from said air flow to heat a circulating water flow;

a cool water loop contacting said air flow heat exchanger for adding energy to said air flow;

a water spray in said air flow heat exchanger intermediate said warm water loop and said cool water loop as an energy exchange medium between said cool water loop and said hot dry air;

a brine concentrating unit receiving relatively dilute brine, wherein said relatively dilute brine is heated by said warm water loop to evaporate water from said brine solution to form a more concentrated brine solution and said evaporated water is condensed by said cool water loop.

2. A brine concentrator according to claim 1, wherein said brine concentrating unit includes a plurality of serially connected stages to progressively concentrate said brine solution.

* * * * *